US007599507B2

(12) United States Patent
Hansen

(10) Patent No.: US 7,599,507 B2
(45) Date of Patent: Oct. 6, 2009

(54) HEARING AID AND A METHOD FOR ENHANCING SPEECH INTELLIGIBILITY

(75) Inventor: Martin Hansen, Oldenburg (DE)

(73) Assignee: Widex A/S, Vaerlose (DK)

( * ) Notice: Subject to any disclaimer, the term of this patent is extended or adjusted under 35 U.S.C. 154(b) by 929 days.

(21) Appl. No.: 11/033,564

(22) Filed: Jan. 12, 2005

(65) Prior Publication Data

US 2005/0141737 A1 Jun. 30, 2005

Related U.S. Application Data

(63) Continuation-in-part of application No. PCT/DK02/00492, filed on Jul. 12, 2002.

(51) Int. Cl.
*H04R 25/00* (2006.01)

(52) U.S. Cl. ..... 381/317; 381/312

(58) Field of Classification Search ..... 381/56, 381/57, 104, 107, 312, 320, 321, 317
See application file for complete search history.

(56) References Cited

U.S. PATENT DOCUMENTS 4,548,082 A * 10/1985 Engebretson et al. ..... 381/320
6,002,966 A 12/1999 Loeb et al.
6,157,727 A 12/2000 Rueda
6,289,247 B1 9/2001 Murad et al.

FOREIGN PATENT DOCUMENTS

EP 1 083 769 A 3/2001
WO WO 01 31632 A 5/2001

OTHER PUBLICATIONS

Hougast, T. et al., "Predicting Speech Intelligibility in Rooms from the Modulation Transfer Function. I. General Room Acoustics" ACUSTICA, 1980, pp. 60-72, vol. 46 Institute for Perception TNO, Soesterberg, The Netherlands.
Fletcher, Harvey et al., "The Perception of Speech and It's Relation to Telephony," The Journal of the Acoustical Society of America, Mar. 1950 pp. 89-151 vol. 22, No. 2, Bell Telephone Laboratories, Inc. Murray Hill, New Jersey.
Dillon, Harvey, "NAL-NL1: A New Procedure For Fitting Non-Linear Hearing AIDS," The Hearing Journal, Apr. 1999, pp. 10-16, vol. 52, No. 4.

* cited by examiner

*Primary Examiner*—Walter F Briney, III
(74) *Attorney, Agent, or Firm*—Sughrue Mion, PLLC

(57) ABSTRACT

A hearing aid (22) having a microphone (1), a processor (53) and an output transducer (12), is adapted for obtaining an estimate of a sound environment, determining an estimate of the speech intelligibility according to the sound environment estimate, and for adapting the transfer function of the hearing aid processor in order to enhance the speech intelligibility estimate. The method according to the invention achieves an adaptation of the processor transfer function suitable for optimizing the speech intelligibility in a particular sound environment. Means for obtaining the sound environment estimate and for determining the speech intelligibility estimate may be incorporated in the hearing aid processor, or they may be wholly or partially implemented in an external processing means (56), adapted for communicating data to the hearing aid processor via an appropriate link.

20 Claims, 5 Drawing Sheets

HEARING AID AND A METHOD FOR ENHANCING SPEECH INTELLIGIBILITY

RELATED APPLICATIONS

The present application is a continuation-in-part of application No. PCT/DK2002/000492, filed on Jul. 12, 2002, in Denmark, the contents of which are incorporated hereinto by reference.

BACKGROUND OF THE INVENTION

1. Field of the Invention

The present invention relates to a hearing aid and to a method for enhancing speech intelligibility. The invention further relates to adaptation of hearing aids to specific sound environments. More specifically, the invention relates to a hearing aid with means for real-time enhancement of the intelligibility of speech in a noisy sound environment. Additionally, it relates to a method of improving listening comfort by means of adjusting frequency band gain in the hearing aid according to real-time determinations of speech intelligibility and loudness.

A modern hearing aid comprises one or more microphones, a signal processor, some means of controlling the signal processor, a loudspeaker or telephone, and, possibly, a telecoil for use in locations fitted with telecoil systems. The means for controlling the signal processor may comprise means for changing between different hearing programmes, e.g. a first programme for use in a quiet sound environment, a second programme for use in a noisier sound environment, a third programme for telecoil use, etc.

Prior to use, the hearing aid must be fitted to the individual user. The fitting procedure basically comprises adapting the level dependent transfer function, or frequency response, to best compensate the user's hearing loss according to the particular circumstances such as the user's hearing impairment and the specific hearing aid selected. The selected settings of the parameters governing the transfer function are stored in the hearing aid. The setting can later be changed through a repetition of the fitting procedure, e.g. to account for a change in impairment. In case of multiprogram hearing aids, the adaptation procedure may be carried out once for each programme, selecting settings dedicated to take specific sound environments into account.

According to the state of the art, hearing aids process sound in a number of frequency bands with facilities for specifying gain levels according to some predefined input/gain-curves in the respective bands.

The input processing may further comprise some means of compressing the signal in order to control the dynamic range of the output of the hearing aid. This compression can be regarded as an automatic adjustment of the gain levels for the purpose of improving the listening comfort of the user of the hearing aid. Compression may be implemented in the way described in the international application WO-99/34642 A1.

Advanced hearing aids may further comprise anti-feedback routines for continuously measuring input levels and output levels in respective frequency bands for the purpose of continuously controlling acoustic feedback howl through lowering of the gain settings in the respective bands when necessary.

However, in all these "predefined" gain adjustment methods, the gain levels are modified according to functions that have been predefined during the programming/fitting of the hearing aid to reflect requirements for generalized situations.

In the past, various researchers have suggested models for the prediction of the intelligibility of speech after a transmission though a linear system. The most well-known of these models is the "articulation index", AI, the speech intelligibility index, SII, and the "speech transmission index", STI, but other indices exist.

2. The Prior Art

Determinations of speech intelligibility have been used to assess the quality of speech signals in telephone lines. At the Bell Laboratories (H. Fletcher and R. H. Galt "The perception of speech and its relation to telephony," J. Acoust. Soc. Am. 22, 89-151 (1950)). Speech intelligibility is also an important issue when planning and designing concert halls, churches, auditoriums and public address (PA) systems.

The ANSI S3.5-1969 standard (revised 1997) provides methods for the calculation of the speech intelligibility index, SII. The SII makes it possible to predict the intelligible amount of the transmitted speech information, and thus, the speech intelligibility in a linear transmission system. The SII is a function of the system's transfer function, i.e. indirectly of the speech spectrum at the output of the system. Furthermore, it is possible to take both the effects of a masking noise and the effects of a hearing aid user's hearing loss into account in the SII.

According to this ANSI standard, the SII includes a frequency weighing dependent band, as the different frequencies in a speech spectrum differ in importance with regard to SII. The SII does, however, account for the intelligibility of the complete speech spectrum, calculated as the sum of values for a number of individual frequency bands.

The SII is always a number between 0 (speech is not intelligible at all) and 1 (speech is fully intelligible). The SII is, in fact, an objective measure of the system's ability to convey individual phonemes, and thus, hopefully, of making it possible for the listener to understand what is being said. It does not take language, dialect, or lack of oratorical gift with the speaker into account.

In an article "Predicting Speech Intelligibility in Rooms from the Modulation Transfer Function" (Acoustica Vol 46, 1980), T. Houtgast, H. J. M. Steeneken and R. Plomp present a scheme for predicting speech intelligibility in rooms. The scheme is based on the Modulation Transfer Function (MTF), which, among other things, takes the effects of the room reverberation, the ambient noise level and the talkers vocal output into account. The MTF can be converted into a single index, the Speech Transmission Index, or STI.

An article "NAL-NL1: A new procedure for fitting non-linear hearing aids" in The Hearing Journal, April 199, Vol.52, No.4 describes a fitting rule selected for maximizing speech intelligibility while keeping overall loudness at a level no greater than that perceived by a normal-hearing person listening to the same sound. A number of audiograms and a number of speech levels have been considered.

Modem fitting of hearing aids also take speech intelligibility into account, but the resulting fitting of a particular hearing aid has always been a compromise based on a theoretically, or empirically derived, fixed estimate. The preferred, contemporary measure of speech intelligibility is the speech intelligibility index, or SII, as this method is well-defined, standardized, and gives fairly consistent results. Thus, this method will be the only one considered in the following, with reference to the ANSI S3.5-1997 standard.

Many of the applications of a calculated speech intelligibility index utilize only a static index value, maybe even derived from conditions that are different from those present where the speech intelligibility index will be applied. These conditions may include reverberation, muffling, a change in the level or spectral density of the noise present, a change in the transfer function of the overall speech transmission path (including the speaker, the listening room, the listener, and some kind of electronic transmission means), distortion, and room damping.

Further, an increase of gain in the hearing aid will always lead to an increase in the loudness of the amplified sound, which may in some cases lead to an unpleasantly high sound level, thus creating loudness discomfort for the hearing aid user.

The loudness of the output of the hearing aid may be calculated according to a loudness model, e.g. by the method described in an article by B. C. J. Moore and B. R. Glasberg "A revision of Zwicker's loudness model" (Acta Acustica Vol. 82 (1996) 335-345), which proposes a model for calculation of loudness in normal-hearing and hearing-impaired subjects. The model is designed for steady state sounds, but an extension of the model allows calculations of loudness of shorter transient-like sounds, too. Reference is made to ISO standard 226 (ISO 1987) concerning equal loudness contours.

A measure for the speech intelligibility may be computed for any particular sound environment and setting of the hearing aid by utilizing any of these known methods. The different estimates of speech intelligibility corresponding to the speech and noise amplified by a hearing aid will be dependent on the gain levels in the different frequency bands of the hearing loss. However, a continuous optimization of speech intelligibility and/or loudness requires continuous analysis of the sound environment and thus involves extensive computations beyond what has been considered feasible for a processor in a hearing aid.

SUMMARY OF THE INVENTION

The inventor has realized the fact that it is possible to devise a dedicated, automatic adjustment of the gain settings which may enhance the speech intelligibility while the hearing aid is in use, and which is suitable for implementation in a low power processor, such as a processor in a hearing aid.

This adjustment requires the capability of increasing or decreasing the gain independently in the different bands depending on the current sound situation. For bands with high noise levels, e.g., it may be advantageous to decrease the gain, while an increase of gain can be advantageous in bands with low noise levels, in order to enhance the SII. However, such a simple strategy will not always be an optimal solution, as the SII also takes inter-band interactions, such as mutual masking, into account. A precise calculation of the SII is therefore necessary.

The object of the invention is to provide a method and a means for enhancing the speech intelligibility in a hearing aid in varying sound environments. It is a further object to do this while at the same time preventing the hearing aid from creating loudness discomfort.

It is a further object of the invention to provide a method and means for enhancing the speech intelligibility in a hearing aid, which can be implemented at low power consumption.

According to the invention, in a first aspect, this is obtained in a method of processing a signal in a hearing aid processor, comprising receiving an input signal from a microphone, splitting the input signal into a number of frequency band input signals, selecting a gain vector representing levels of gain for respective frequency band signals, calculating an estimate of the sound environment representing a set of frequency band speech levels and a set of frequency band noise levels, calculating a speech intelligibility index based on the estimate of the sound environment and the gain vector, iteratively varying gain levels of the gain vector up or down in order to determine a gain vector that maximizes the speech intelligibility index, and processing the frequency band input signals according to the gain vector so as to produce an output signal adapted for driving an output transducer.

The enhancement of the speech intelligibility estimate signifies an enhancement of the speech intelligibility in the sound output of the hearing aid. The method according to the invention achieves an adaptation of the processor transfer function suitable for optimizing the speech intelligibility in a particular sound environment.

The sound environment estimate may be updated as often as necessary, i.e. intermittently, periodically or continuously, as appropriate in view of considerations such as requirements to data processing and variability of the sound environment. In state of the art digital hearing aids, the processor will process the acoustic signal with a short delay, preferably smaller than 3 ms, to prevent the user from perceiving the delay between the acoustic signal perceived directly and the acoustic signal processed by the hearing aid, as this can be annoying and impair consistent sound perception. Updating of the transfer function can take place at a much lower pace without user discomfort, as changes due to the updating will generally not be noticed. Updating at e.g. 50 ms intervals will often be sufficient even for fast changing environments. In case of steady environments, updating may be slower, e.g. on demand.

The means for obtaining the sound environment estimate and for determining the speech intelligibility estimate may be incorporated in the hearing aid processor, or they may be wholly or partially implemented in an external processing means, adapted for communicating data to and from the hearing aid processor by an appropriate link.

Assuming that calculating the speech intelligibility index, SII, in real-time would be possible, a lot of these problems could be overcome through using the result of these calculations to compensate for the deteriorated speech intelligibility in some way, e.g. by repeatedly altering the transfer function at some convenient point in the sound transmission chain, preferably in the electronic processing means.

If one further assumes that the SII, which has earlier solely been considered in linear systems, can be calculated and used with an acceptable degree of accuracy in a nonlinear system, the scope of application of the SII may be expanded considerably. It might then, for instance, be used in systems having some kind of nonlinear transfer function, such as in hearing aids which utilize some kind of compression of the sound signal. This application of the SII will be especially successful if the hearing aid has long compression time constants which generally makes the system more linear.

In order to calculate a real-time SII, an estimate of the speech level and the noise level must be known at computation time, as these values are required for the calculation. These level estimates can be obtained with fair accuracy in various ways, for instance by using a percentile estimator. It is assumed that a maximum SII will always exist for a given signal level and a given noise level. If the amplification gain is changed, the SII will change, too.

As it is not feasible to compute a general relationship between the SII and a given change in amplification gain analytically, some kind of numerical optimization routine is needed to determine this relationship in order to determine the particular amplification gain that gives the largest SII value. An implementation of a suitable optimization routine is explained in the detailed part of the specification.

According to an embodiment of the invention, the method further comprises determining the transfer function as a gain vector representing gain values in a number of individual frequency bands in the hearing aid processor, the gain vector being selected for enhancing speech intelligibility. This simplifies the data processing.

According to an embodiment of the invention, the method further comprises determining the gain vector through determining, for a first part of the frequency bands, respective gain values suitable for enhancing speech intelligibility, and determining, for a second part of the frequency bands, respective gain values through interpolation between gain values in respect of the first part of the frequency bands. This simplifies the data processing through cutting down on the number of frequency bands, wherein the more complex optimization algorithm needs to be executed. The first part of the frequency bands will be selected to generally cover the frequency spectrum, while the second part of the frequency bands will be situated interspersed between the frequency bands of the first part, in order that interpolation will provide good results.

According to another embodiment of the invention, the method further comprises transmission of the speech intelligibility estimate to an external fitting system connected to the hearing aid. This may provide a piece of information that may be useful to the user or to an audiologist, e.g. in evaluating the performance and the fitting of the hearing aid, circumstances of a particular sound environment, or circumstances particular to the users auditive perception. External fitting systems suitable for communicating with a hearing aid comprising programming devices are described in WO-90/08448 and in WO-94/22276. Other suitable fitting systems are industry standard systems such as HiPRO or NOAH specified by Hearing Instrument Manufacturers' Software Association (HIMSA).

According to yet another embodiment of the invention, the method further comprises calculating the loudness of the output signal from the gain vector and comparing it to a loudness limit, wherein said loudness limit represents a ratio to the loudness of the unamplified sound in normal hearing listeners, and subsequently adjusting the gain vector as appropriate in order to not exceed the loudness limit. This improves user comfort by ensuring that the loudness of the hearing aid output signal stays within a comfortable range.

The method according to another embodiment of the invention further comprises adjusting the gain vector by multiplying it by a scalar factor selected in such a way that the loudness is lower than, or equal to, the corresponding loudness limit value. This provides a simple implementation of the loudness control.

According to an embodiment of the invention, the method further comprises adjusting each gain value in the gain vector in such a way that each of the gain values is lower than, or equal to, the corresponding loudness limit value in the loudness vector.

The method according to another embodiment of the invention further comprises determining a speech level estimate and a noise level estimate of the sound environment. These estimates may be obtained by a statistical analysis of the sound signal over time. One method comprises identifying, through level analysis, time frames where speech is present, averaging the sound level within those time frames to produce the speech level estimate, and averaging the levels within remaining time frames to produce the noise level estimate.

The invention, in a second aspect, provides a hearing aid comprising an input transducer, a processor, and an acoustic output transducer, said processor having a filter block, a sound environment estimator, a multiplication means, a speech optimization block, and a block overlap means, said filter block being adapted for splitting an input signal from the input transducer into frequency band signals, said speech optimization block being adapted for selecting a gain vector representing levels of gain for respective frequency band signals, for calculating, based on the frequency band signals and the gain vector, a speech intelligibility index, and for optimizing the gain vector through iteratively varying the gain vector, calculating respective indices of speech intelligibility and selecting a vector that maximizes the speech intelligibility index, said multiplication means being adapted for applying the gain vector against the frequency band signals, and said block overlap means being adapted for forming a signal for the acoustic output transducer.

The hearing loss vector comprises a set of values representing hearing deficiency measurements taken in various frequency bands. The hearing aid according to the invention in this aspect provides a piece of information, which may be used in adaptive signal processing in the hearing aid for enhancing speech intelligibility, or it may be presented to the user or to a fitter, e.g. by visual or acoustic means.

According to an embodiment of the invention, the hearing aid comprises means for enhancing speech intelligibility by way of applying appropriate adjustments to a number of gain levels in a number of individual frequency bands in the hearing aid.

According to another embodiment, the hearing aid comprises means for comparing the loudness corresponding to the adjusted gain values in the individual frequency bands in the hearing aid to a corresponding loudness limit value, said loudness limit value representing a ratio to the loudness of the unamplified sound, and means for adjusting the respective gain values as appropriate in order not to exceed the loudness limit value.

The invention, in a third aspect, provides a method of fitting a hearing aid to a sound environment, comprising selecting a setting for an initial hearing aid transfer function according to a general fitting rule, calculating an estimate of the sound environment by calculating the speech level and the noise level in each among a set of frequency bands, calculating a speech intelligibility index based on the estimate of the sound environment and the initial transfer function, and adapting the initial setting to provide a modified transfer function suitable for enhancing the speech intelligibility.

By this method, the hearing aid is adapted to a specific environment, which permits an adaptation targeted for superior speech intelligibility in that environment.

The invention in a fourth aspect, provides a method of processing a signal in a hearing aid, the hearing aid having a microphone, a processor and an output transducer, comprising obtaining an estimate of a sound environment, determining an estimate of the speech intelligibility according to the sound environment estimate and to the transfer function of the hearing aid processor, and adapting the transfer function in order to enhance the speech intelligibility estimate.

The invention in a fifth aspect, provides a hearing aid comprising means for calculating a speech intelligibility estimate as a function of at least one among a number of speech levels, at least one among a number of noise levels and a hearing loss vector in a number of individual frequency bands.

BRIEF DESCRIPTION OF THE DRAWINGS

The invention will now be described in more detail with reference to the accompanying drawings, where.

DETAILED DESCRIPTION

Figure 1:
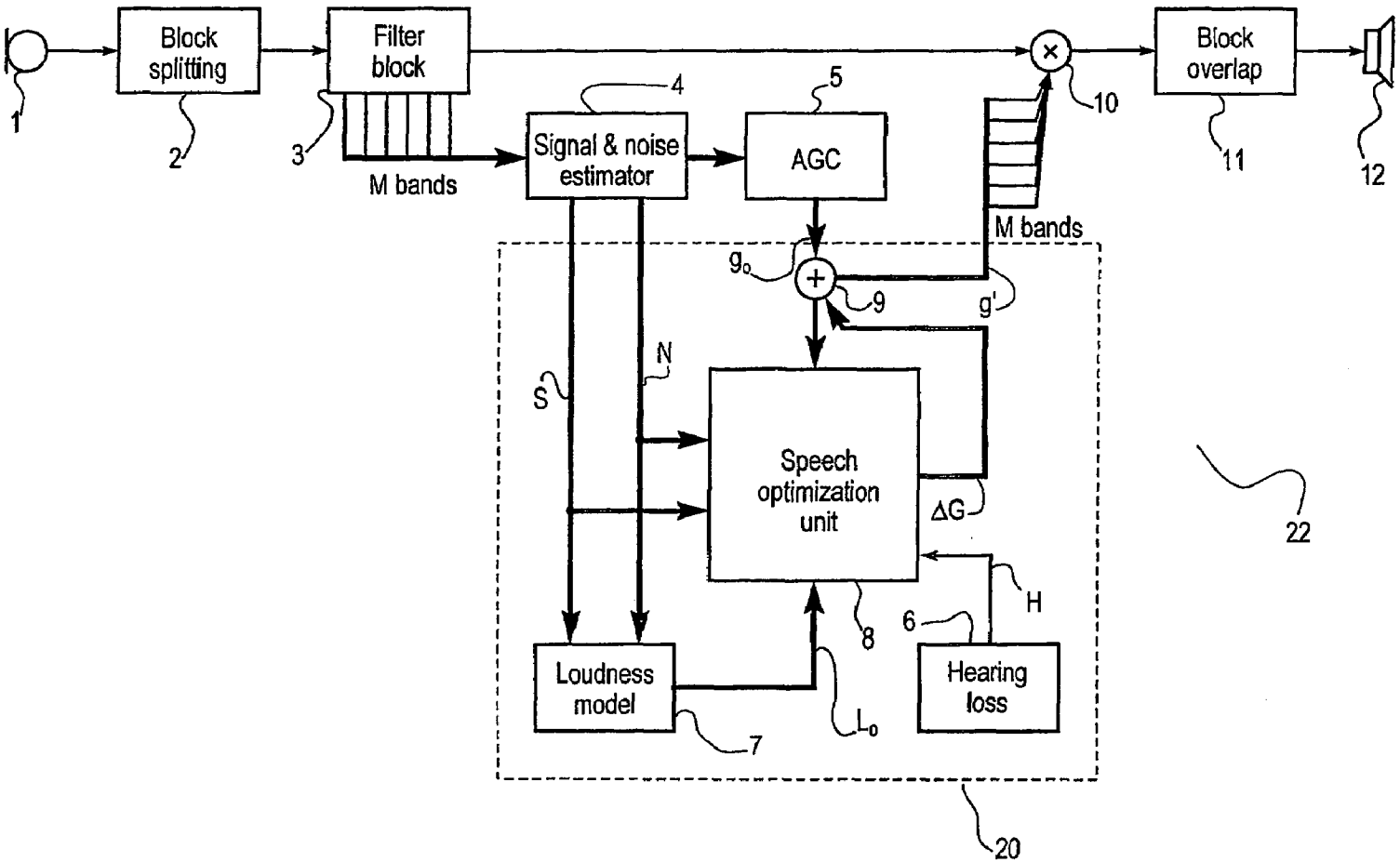
FIG. 1 shows a schematic block diagram of a hearing aid with speech optimization means according to the invention.

The hearing aid 22 in FIG. 1 comprises a microphone 1 connected to a block splitting means 2, which further connects to a filter block 3. The block splitting means 2 may apply an ordinary, temporal, optionally weighted, windowing function, and the filter block 3 may preferably comprise a predefined set of low pass, band pass and high pass filters defining the different frequency bands in the hearing aid 22.

The total output from the filter block 3 is fed to a multiplication point 10, and the output from the separate bands 1, 2, . . . M in filter block 3 are fed to respective inputs of a speech and noise estimator 4. The outputs from the separate filter bands are shown in FIG. 1 by a single, bolder, signal line. The speech level and noise level estimator may be implemented as a percentile estimator, e.g. of the kind presented in the international application WO-98/27787 A1.

The output of multiplication point 10 is further connected to a loudspeaker 12 via a block overlap means 11. The speech and noise estimator 4 is connected to a loudness model means 7 by two multi-band signal paths carrying two separate signal parts, S (signal) and N (noise), which two signal parts are also fed to a speech optimization unit 8. The output of the loudness model means 7 is further connected to the output of the speech optimization unit 8.

The loudness model means 7 uses the S and N signal parts in an existing loudness model in order to ensure that the subsequently calculated gain values from the speech optimization unit 8 do not produce a loudness of the output signal of the hearing aid 22 that exceeds a predetermined loudness $L_0$, which is the loudness of the unamplified sound for normal hearing subjects.

The hearing loss model means 6 may advantageously be a representation of the hearing loss compensation profile already stored in the working, hearing aid 22, fitted to a particular user without necessarily taking speech intelligibility into consideration.

The speech and noise estimator 4 is further connected to an AGC means 5, which in turn is connected to one input of a summation point 9, feeding it with the initial gain values $g_0$. The AGC means 5 is preferably implemented as a multiband compressor, for instance of the kind described in WO-99/34642.

Figure 2:
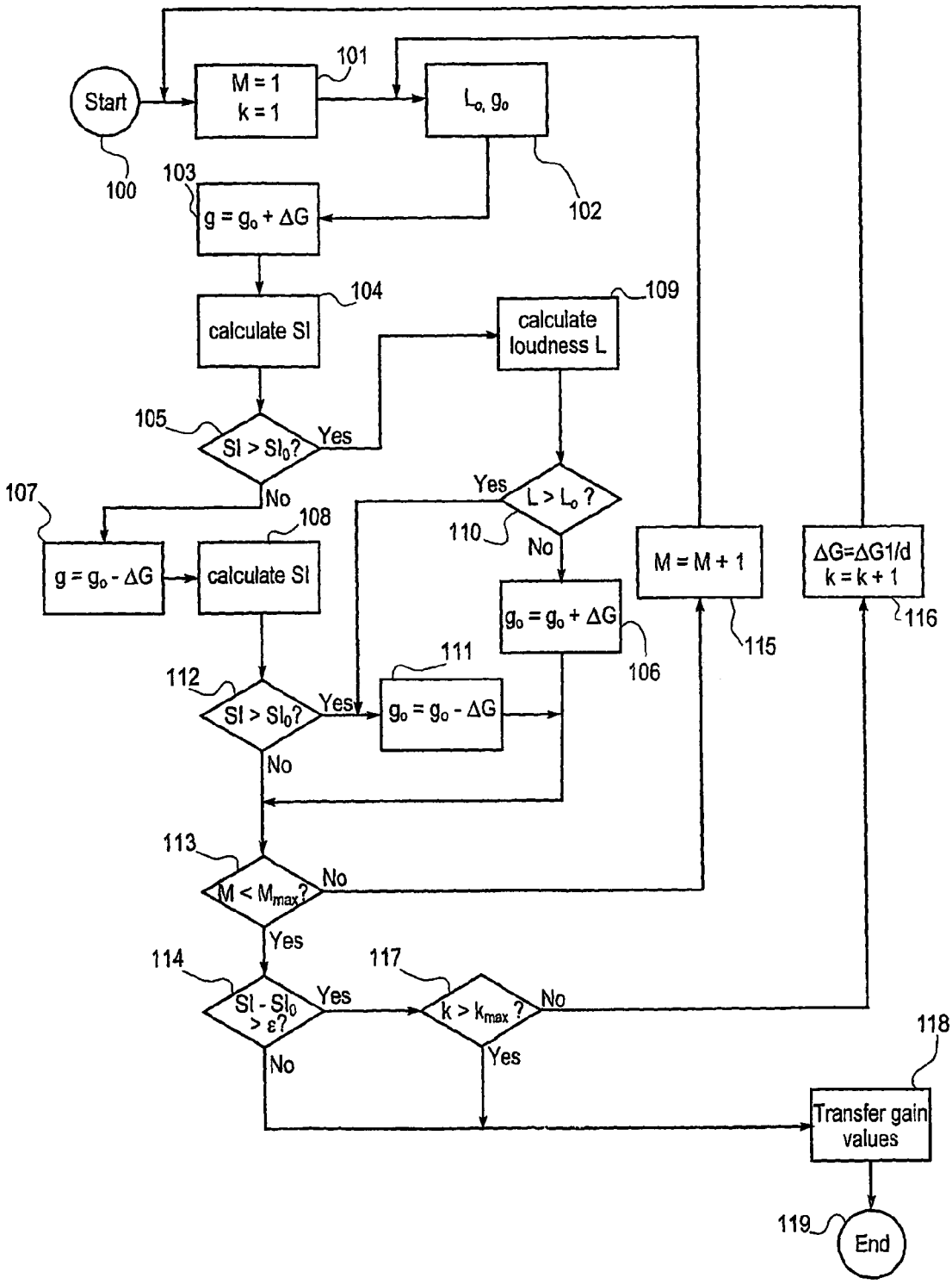
FIG. 2 is a flow chart showing a preferred optimization algorithm utilizing a variant of the 'steepest gradient' method.

The speech optimization unit 8 comprises means for calculating a new set of optimized gain value changes iteratively, utilizing the algorithm described in the flow chart in FIG. 2. The output of the speech optimization unit 8, $\Delta G$, is fed to one of the inputs of summation point 9. The output of the summation point 9, g', is fed to the input of multiplication point 10 and to the speech optimization unit 8. The summation point 9, loudness model means 7 and speech optimization unit 8 forms the optimizing part of the hearing aid according to the invention. The speech optimization unit 8 also contains a loudness model.

In the hearing aid 22 in FIG. 1, speech signals and noise signals are picked up by the microphone 1 and split by the block splitting means 2 into a number of temporal blocks or frames. Each of the temporal blocks or frames, which may preferably be approximately 50 ms in length, is processed individually. Thus each block is divided by the filter block 3 into a number of separate frequency bands.

The frequency-divided signal blocks are then split into two separate signal paths where one goes to the speech and noise estimator 4 and the other goes to a multiplication point 10. The speech and noise estimator 4 generates two separate vectors, i.e. N, 'assumed noise', and S, 'assumed speech'. These vectors are used by the loudness model means 6 and the speech optimization unit 8 to distinguish between the 'assumed noise level' and the 'assumed speech level'.

The speech and noise estimator 4 may be implemented as a percentile estimator. A percentile is, by definition, the value for which the cumulative distribution is equal to or below that percentile. The output values from the percentile estimator each correspond to an estimate of a level value below which the signal level lies within a certain percentage of the time during which the signal level is estimated. The vectors preferably correspond to a 10% percentile (the noise, N) and a 90% percentile (the speech, S) respectively, but other percentile figures can be used.

In practice, this means that the noise level vector N comprises the signal levels below which the frequency band signal levels lie during 10% of the time, and the speech level vector S is the signal level below which the frequency band signal levels lie during 90% of the time. Additionally, the speech and noise estimator 4 presents a control signal to the AGC 5 for adjustment of the gain in the different frequency bands. The speech and noise estimator 4 implements a very efficient way of estimating for each block the frequency band levels of noise as well as the frequency band levels of speech.

The gain values $g_0$ from the AGC 5 are then summed with the gain changes $\Delta G$ in the summation point 9 and presented as a gain vector g' to the multiplication point 10 and to the speech optimization means 8. The speech signal vector S and the noise signal vector N from the speech and noise estimator 4 are presented to the speech input and the noise input of the speech optimization unit 8 and the corresponding inputs of the loudness model means 7.

The loudness model means 7 contains a loudness model, which calculates the loudness of the input signal for normal hearing listeners, $L_0$. A hearing loss model vector H from the hearing loss model means 6 is presented to the input of the speech optimization unit 8.

After optimizing the speech intelligibility, preferably by means of the iterative algorithm shown in FIG. 2, the speech optimization unit 8 presents a new gain change $\Delta G$ to the inputs of summation points 9 and an altered gain value g' to the multiplication point 10. The summation point 9 adds the output vector $\Delta G$ to the input vector $g_0$, thus forming a new, modified vector g' for the input of the multiplication point 10 and to the speech optimization unit 8. Multiplication point 10 multiplies the gain vector g' by the signal from the filter block 3 and presents the resulting, gain adjusted signal to the input of block overlap means 11.

The block overlap means may be implemented as a band interleaving function and a regeneration function for recreating an optimized signal suitable for reproduction. The block overlap means 11 forms the final, speech-optimized signal block and presents this via suitable output means (not shown) to the loudspeaker or hearing aid telephone 12.

FIG. 2 is a flow chart of a preferred speech optimization algorithm comprising a start point block 100 connected to a subsequent block 101, where an initial frequency band number M=1 is set. In the following step 102, an initial gain value $g_0$ is set. In step 103, a new gain value g is defined as $g_0$ plus a gain value increment ΔG, followed by the calculation of the proposed speech intelligibility value SI in step 104. After step 104, the speech intelligibility value SI is compared to an initial value $SI_0$ in step 105.

If the new SI value is larger than the initial value $SI_0$, the routine continues in step 109, where the loudness L is calculated. This new loudness L is compared to the loudness $L_0$ in step 110. If the loudness L is larger than the loudness $L_0$, and the new gain value $g_0$ is set to $g_0$ minus the gain value increment ΔG in step 111. Otherwise, the routine continues in step 106, where the new gain value g is set to $g_0$ plus the incremental gain value ΔG. The routine then continues in step 113 by examining the band number M to see if the highest number of frequency bands $M_{max}$ has been reached.

If, however, the new SI value calculated in step 104 is smaller than the initial value $SI_0$, the new gain value $g_0$ is set to $g_0$ minus a gain value increment ΔG in step 107. The proposed speech intelligibility value SI is then calculated again for the new gain value g in step 108.

The proposed speech intelligibility SI is again compared to the initial value $SI_0$ in step 112. If the new value SI is larger than the initial value $SI_0$, the routine continues in step 111, where the new gain value $g_0$ is defined as $g_0$ minus ΔG.

If neither an increased or a decreased gain value ΔG results in an increased SI, the initial gain value $g_0$ is preserved for frequency band M. The routine continues in step 113 by examining the band number M to see if the highest number of frequency bands $M_{max}$ has been reached. If this is not the case, the routine continues via step 115, incrementing the number of the frequency band subject to optimization by one. Otherwise, the routine continues in step 114 by comparing the new SI vector with the old vector $SI_0$ to determine if the difference between them is smaller than a tolerance value ϵ.

If any of the M values of SI calculated in each band in either step 102 or step 108 are substantially different from $SI_0$, i.e. the vectors differ by more than the tolerance value ϵ, the routine proceeds to step 117, where the iteration counter k is compared to a maximum iteration number $k_{max}$.

If k is smaller than $k_{max}$, the routine continues in step 116, by defining a new gain increment ΔG by multiplying the current gain increment by a factor 1/d, where d is a positive number greater than 1, and incrementing the iteration counter k. The routine then continues by iteratively calculating all $M_{max}$ frequency bands again in step 101, starting over with the first frequency band M=1. If k is larger than $k_{max}$ the new, individual gain values are transferred to the transfer function of the signal processor in step 118 and terminates the optimization routine in step 119. This is also the case if the SI did not increase by more than ϵ in any band (step 114). Then the need for further optimization no longer exists, and the resulting, speech-optimized gain value vector is transferred to the transfer function of the signal processor in step 118 and the optimization routine is terminated in step 119.

In essence, the algorithm traverses the $M_{max}$-dimensional vector space of $M_{max}$ frequency band gain values iteratively, optimizing the gain values for each frequency band with respect to the largest SI value. Practical values for the variables ϵ and d in this example are ϵ=0.005 and d=2. The number of frequency bands $M_{max}$ may be set to 12 or 15 frequency bands A convenient starting point for ΔG is 10 dB. Simulated tests have shown that the algorithm usually converges after four to six iterations, i.e. a point is reached where terminating the difference between the old $SI_0$ vector and the new SI vector becomes negligible and thus execution of subsequent iterative steps may be terminated. Thus, this algorithm is very effective in terms of processing requirements and speed of convergence.

Figure 3:
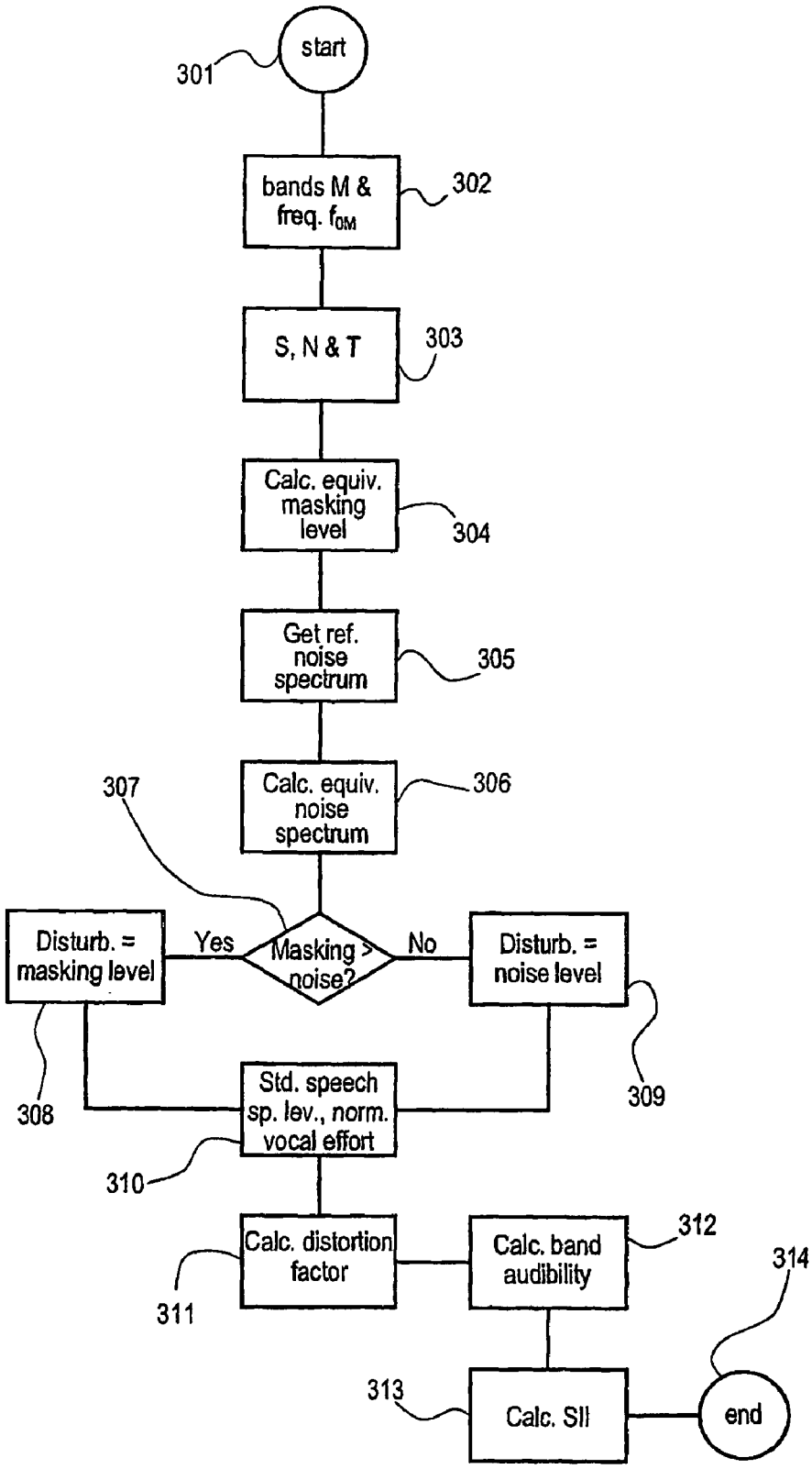
FIG. 3 is a flow chart showing calculation of speech intelligibility using the SII method.

The flow chart in FIG. 3 illustrates how the SII values needed by the algorithm in FIG. 2 can be obtained. The SI algorithm according to FIG. 3 implements the steps of each of steps 104 and 108 in FIG. 2, and it is assumed that the speech intelligibility index, SII, is selected as the measurement for speech intelligibility, SI. The SI algorithm initializes in step 301, and in steps 302 and 303 the SI algorithm determines the number of frequency bands $M_{max}$, the frequencies $f_{0M}$ for the individual bands, the equivalent speech spectrum level S, the internal noise level N and the hearing threshold T for each frequency band.

In order to utilize the SII calculation, it is necessary to determine the number of individual frequency bands before any calculation is taking place, as the method of calculating several of the involved parameters depend on the number and bandwidth of these frequency bands.

The equivalent speech spectrum level S is calculated in step 304 as:

$$(1)\quad S = E_b(f) - 10\log\left(\frac{\Delta(f)}{\Delta_0(f)}\right),$$

where $E_b$ is the SPL of the speech signal at the output of the band pass filter with the center frequency f, Δ(f) is the band pass filter bandwidth and $\Delta_0(f)$ is the reference bandwidth of 1 Hz. The reference internal noise spectrum $N_i$ is obtained in step 305 and used for calculation of the equivalent internal noise spectrum $N'_i$ and, subsequently, the equivalent masking spectrum level $Z_i$. The latter can be expressed as:

$$(2)\quad Z_i = 10\log\left(10^{0.1N'_i} + \sum_{k}^{i-1} 10^{0.1\left[B_k + 3.32C_k\log\left(\frac{F_i}{h_k}\right)\right]}\right),$$

where $N'_i$ is the equivalent internal noise spectrum level, $B_k$ is the larger value of $N'_i$ and the self-speech masking spectrum level $V_i$, expressed as:

$$V_i = S - 24, \quad (3)$$

$F_i$ is the critical band center frequency, and $h_k$ is the higher frequency band limit for the critical band k. The slope per octave of the spread of masking, $C_i$, is expressed as:

$$C_i = -80 + 0.6[B_i + 10\log(h_i - l_i)], \quad (4)$$

where $l_i$ is the lower frequency band limit for the critical band i.

The equivalent internal noise spectrum level $X'_i$ is calculated in step 306 as:

$$X'_i = X_i + T'_i, \quad (5)$$

where $X_i$ equals the noise level N and $T_i$ is the hearing threshold in the frequency band in question.

In step 307, the equivalent masking spectrum level $Z_i$ is compared to the equivalent internal noise spectrum level $N'_i$, and, if the equivalent masking spectrum level $Z_i$ is the largest, the equivalent disturbance spectrum level $D_i$ is made equal to the equivalent masking spectrum level $Z_i$ in step 308, and otherwise made equal to the equivalent internal noise spectrum level $N'_i$ in step 309.

The standard speech spectrum level at normal vocal effort, $U_i$, is obtained in step 310, and the level distortion factor $L_i$ is calculated with the aid of this reference value as:

$$(6)\quad L_i = 1 - \frac{(S - U_i - 10)}{160}.$$

The band audibility $A_i$ is calculated in step 312 as:

$$(7)\quad A_i = L_i \cdot \left[\frac{(S - D_i + 15)}{30}\right],$$

and, finally, the total speech intelligibility index SII is calculated in step 313 as:

$$(8)\quad SII = \sum_{i=1}^{n} I_i \cdot A_i,$$

where $I_i$ is the band importance function used to weigh the audibility with respect to speech frequencies, and the speech intelligibility index is summed for each frequency band. The algorithm terminates in step 314, where the calculated SII value is returned to the calling algorithm (not shown).

The SII represents a measure of an ability of a system to faithfully reproduce phonemes in speech coherently, and thus, conveying the information in the speech transmitted through the system.

Figure 4:
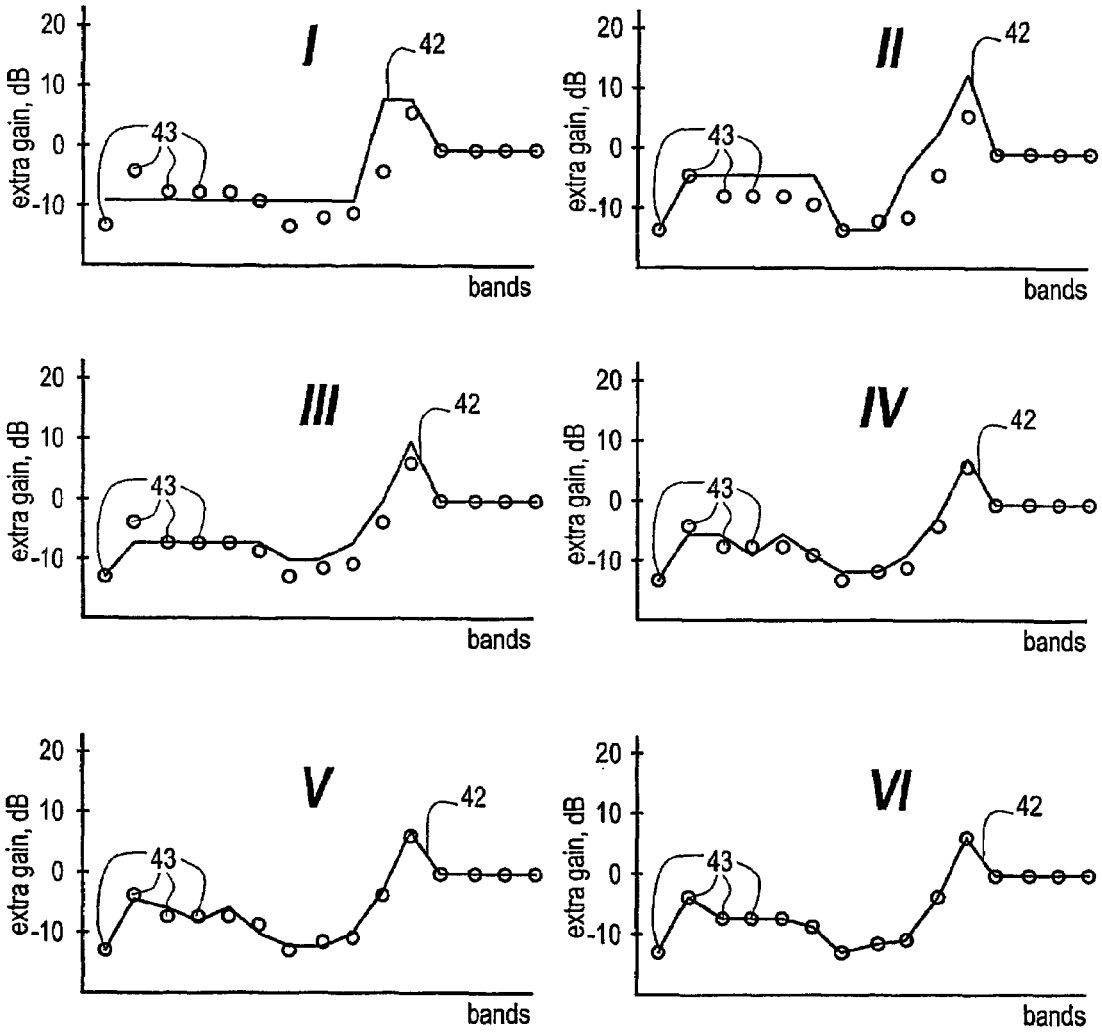
FIG. 4 is a graph showing different gain values during individual steps of the iteration algorithm in FIG. 2.

FIG. 4 shows six iterations in the SII optimizing algorithm according to the invention. Each step shows the final gain values 43, illustrated in FIG. 4 as a number of open circles, corresponding to the optimal SII in fifteen bands, and the SII optimizing algorithm adapts a given transfer function 42, illustrated in FIG. 4 as a continuous line, to meet the gain for the optimal gain values 43. The iteration starts at an extra gain of 0 dB in all bands and then makes a step of $\pm\Delta G$ in all gain values in iteration step I, and continues by iterating the gain values 42 in step II, III, IV, V and VI in order to adapt the gain values 42 to the optimal SII values 43.

The optimal gain values 43 are not known to the algorithm prior to computation, but as the individual iteration steps I to VI in FIG. 4 shows, the gain values in the example converges after only six iterations.

Figure 5:
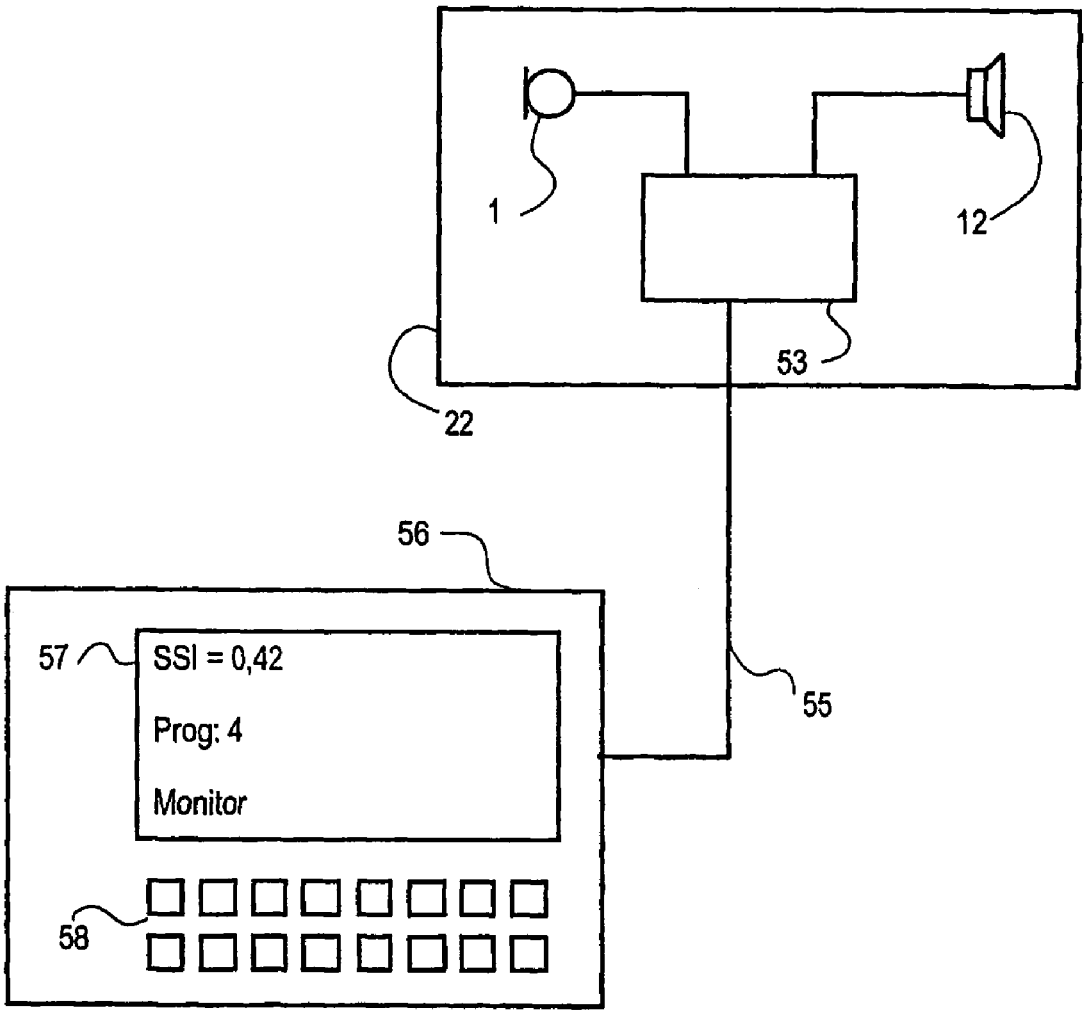
FIG. 5 is schematic representation of a programming device communicating with a hearing aid according to the invention.

FIG. 5 is a schematic diagram showing a hearing aid 22, comprising a microphone 1, a transducer or loudspeaker 12, and a signal processor 53, connected to a hearing aid fitting box 56, comprising a display means 57 and an operating panel 58, via a suitable communication link cable 55.

The communication between the hearing aid 51 and the fitting box 56 is implemented by utilizing the standard hearing aid industry communicating protocols and signaling levels available to those skilled in the art. The hearing aid fitting box comprises a programming device adapted for receiving operator inputs, such as data about the users hearing impairment, reading data from the hearing aid, displaying various information and programming the hearing aid by writing into a memory in the hearing aid suitable programme parameters. Various types of programming devices may be suggested by those skilled in the art. E.g. some programming devices are adapted for communicating with a suitably equipped hearing aid through a wireless link. Further details about suitable programming devices may be found in WO-90/08448 and in WO-94/22276.

The transfer function of the signal processor 53 of the hearing aid 22 is adapted to enhance speech intelligibility by utilizing the method according to the invention, and further comprises means for communicating the resulting SII value via the link cable 55 to the fitting box 56 for displaying by the display means 57.

The fitting box 56 is able to force a readout of the SII value from the hearing aid 22 on the display means 57 by transmitting appropriate control signals to the hearing aid processor 53 via the link cable 55. These control signals instruct the hearing aid processor 53 to deliver the calculated SII value to the fitting box 56 via the same link cable 55.

Such a readout of the SII value in a particular sound environment may be of great help to the fitting person and the hearing aid user, as the SII value gives an objective indication of the speech intelligibility experienced by the user of the hearing aid, and appropriate adjustments thus can be made to the operation of the hearing aid processor. It may also be of use by the fitting person by providing clues to whether a bad intelligibility of speech is due to a poor fitting of the hearing aid or maybe due to some other cause.

Under most circumstances, the SII as a function of the transfer function of a sound transmission system has a relatively nice, smooth shape without sharp dips or peaks. If this is assumed to always be the case, a variant of an optimization routine, known as the steepest gradient method, can be used.

If the speech spectrum is split into a number of different frequency bands, for instance by using a set of suitable band pass filters, the frequency bands can be treated independently of each other, and the amplification gain for each frequency band can be adjusted to maximize the SII for that particular frequency band. This makes it possible to take the varying importance of the different speech spectrum frequency bands according to the ANSI standard into account.

In another embodiment, the fitting box incorporates data processing means for receiving a sound input signal from the hearing aid, providing an estimate of the sound environment based on the sound input signal, determining an estimate of the speech intelligibility according to the sound environment estimate and to the transfer function of the hearing aid processor, adapting the transfer function in order to enhance the speech intelligibility estimate, and transmitting data about the modified transfer function to the hearing aid in order to modify the hearing aid programme.

The general principles for iterative calculation of the optimal SII is described in the following. Given a sound transmission system with a known transfer function, an initial value $g_i(k)$, where k is the iterative optimization step, can be set for each frequency band i in the transfer function.

An initial gain increment, $\Delta G_i$, is selected, and the gain value $g_i$ is changed by an amount $\pm\Delta G_i$ for each frequency band. The resulting change in SII is then determined, and the gain value $g_i$ for the frequency band i is changed accordingly if SII is increased by the process in the frequency band in question. This is done independently in all bands. The gain increment $\Delta G_i$ is then decreased by multiplying the initial value by a factor 1/d, where d is a positive number larger than 1. If a change in gain in a particular frequency band does not result in any further significant increase in SII for that frequency band, or if k iterations has been performed without any increase in SII, the gain value $g_i$ for that particular frequency band is left unaltered by the routine.

The iterative optimization routine can be expressed as:

$$(9)\quad g_i(k+1) = g_i(k) + \mathrm{sign}\left(\left|\frac{\partial SII(\vec{g})}{\partial G_i}\right|\right)\cdot \Delta G_i(k),\ \forall\, i$$

Thus, the change in $g_i$ is determined by the sign of the gradient only, as opposed to the standard steepest-gradient optimization algorithm. The gain increment $\Delta G_i$ may be predefined as expressed in:

$$\Delta G_{S,D}(k)=\max(1,\mathrm{rounds}(S\cdot e^{-D(k-1)})),\ k=1,2,3 \quad (10)$$

rather than being determined by the gradient. This saves computation time.

This step size rule and the choice of the best suitable parameters S and D are the result of developing a fast converging iterative search algorithm with a low computational load.

A possible criterion for convergence of the iterative algorithm is:

$$SII_{max}(k) \geqq SII_{max}(k-1), \quad (11)$$

$$|SII_{max}(k)-SII_{max}(k-2)|<\epsilon \text{ and}, \quad (12)$$

$$k \leqq 5; k_{max}. \quad (13)$$

Thus, the SII determined by alternatingly closing in on the value $SII_{max}$ between two adjacent gain vectors has to be closer to $SII_{max}$ than a fixed minimum $\epsilon$, and the iteration is stopped after $k_{max}$ steps, even if no optimal SII value has been found.

This is only an example. The invention covers many other implementations where speech intelligibility is enhanced in real time.

The invention claimed is:

1. A method of processing a signal in a hearing aid processor, comprising receiving an input signal from a microphone, splitting the input signal into a number of frequency band input signals, selecting a gain vector representing levels of gain for respective frequency band signals, calculating an estimate of the sound environment representing a set of frequency band speech levels and a set of frequency band noise levels, calculating a speech intelligibility index based on the estimate of the sound environment and the gain vector, iteratively varying gain levels of the gain vector up or down in order to determine a gain vector that maximizes the speech intelligibility index, and processing the frequency band input signals according to the gain vector so as to produce an output signal adapted for driving an output transducer.

2. The method according to claim 1, wherein the step of iteratively varying the gain levels comprises determining for a first part of the frequency bands respective gain levels suitable for enhancing speech intelligibility and determining for a second part of the frequency bands respective gain levels through interpolation between gain levels in respect of the first part of the frequency bands.

3. The method according to claim 1, comprising transmitting the speech intelligibility index from the hearing aid and to an external fitting system.

4. The method according to claim 1, comprising calculating a loudness of the output signal according to the gain vector, comparing the loudness to a loudness upper limit, and adjusting the gain vector as appropriate in order to not exceed the loudness upper limit.

5. The method according to claim 4, comprising adjusting the gain vector by multiplying it by a scalar factor selected in such a way that the loudness according to the adjusted gain vector is lower than, or equal to, the corresponding loudness upper limit.

6. The method according to claim 1, comprising adjusting a selected gain level in the gain vector in such a way that the loudness according to the adjusted gain vector is lower than, or equal to, the corresponding loudness upper limit.

7. The method according to claim 1, comprising calculating the speech intelligibility estimate as an articulation index.

8. The method according to claim 1, comprising calculating the speech intelligibility estimate as a modulation transmission index.

9. The method according to claim 1, comprising calculating the speech intelligibility estimate as a speech transmission index.

10. The method according to claim 1, comprising obtaining in respect of each frequency band a speech level estimate and a noise level estimate as respective percentile values of the sound environment.

11. The method according to claim 1, comprising processing the input signal in real time while updating the gain vector intermittently.

12. The method according to claim 1, comprising processing the input signal in real time while updating the gain vector on user request.

13. The method according to claim 1, comprising the steps of calculating the speech intelligibility index as a function of the speech level values, the noise level values, and a hearing loss vector.

14. A hearing aid comprising an input transducer, a processor, and an acoustic output transducer, said processor having a filter block, a sound environment estimator, a multiplication means, a speech optimization block, and a block overlap means, said filter block being adapted for splitting an input signal from the input transducer into frequency band signals, said speech optimization block being adapted for selecting a gain vector representing levels of gain for respective frequency band signals, for calculating, based on the frequency band signals and the gain vector, a speech intelligibility index, and for optimizing the gain vector through iteratively varying the gain vector, calculating respective indices of speech intelligibility and selecting a vector that maximizes the speech intelligibility index, said multiplication means being adapted for applying the gain vector against the frequency band signals, and said block overlap means being adapted for forming a signal for the acoustic output transducer.

15. The hearing aid according to claim 14, wherein said speech optimization block is adapted for applying adjustments to selected levels of gain in respect of selected frequency bands.

16. The hearing aid according to claim 14, comprising means for calculating a loudness according to a selected gain vector, for comparing the calculated loudness to a loudness upper limit, and for adjusting the selected gain vector as appropriate in order not to exceed the loudness upper limit.

17. A method of processing a signal in a hearing aid, the hearing aid having a microphone, a processor and an output transducer, comprising obtaining an estimate of a sound environment, determining an estimate of the speech intelligibility according to the sound environment estimate and to the transfer function of the hearing aid processor, and adapting the transfer function in order to enhance the speech intelligibility estimate.

18. A hearing aid comprising an input transducer, a processor, and an acoustic output transducer, said hearing aid including means for calculating a speech intelligibility estimate as a function of at least one among a number of speech levels, at least one among a number of noise levels and a hearing loss vector in a number of individual frequency bands.

19. A hearing aid according to claim 18, wherein said means for calculating is included in said processor.

20. A hearing aid comprising:

means for obtaining a number of speech levels, means for obtaining a number of noise levels, and means for calculating a speech intelligibility estimate as a function of at least one among the number of speech levels, at least one among the number of noise levels and a hearing loss vector in a number of individual frequency bands.

* * * * *

UNITED STATES PATENT AND TRADEMARK OFFICE

CERTIFICATE OF CORRECTION

PATENT NO. : 7,599,507 B2
APPLICATION NO. : 11/033564
DATED : October 6, 2009
INVENTOR(S) : Martin Hansen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1272 days.

Signed and Sealed this

Twenty-eighth Day of September, 2010

David J. Kappos

David J. Kappos
*Director of the United States Patent and Trademark Office*